US006609279B2

(12) United States Patent
Kogler

(10) Patent No.: US 6,609,279 B2
(45) Date of Patent: Aug. 26, 2003

(54) FILLING MATERIAL, AND METHOD OF AND ARRANGEMENT FOR MAKING SUCH A FILLING MATERIAL

(76) Inventor: Andreas Kogler, Kindergartenstrasse 1, 2493 Lichtenwörth (AT)

( * ) Notice: Subject to any disclaimer, the term of this patent is extended or adjusted under 35 U.S.C. 154(b) by 0 days.

(21) Appl. No.: 09/825,679

(22) Filed: Apr. 4, 2001

(65) Prior Publication Data

US 2001/0016246 A1 Aug. 23, 2001

Related U.S. Application Data

(63) Continuation of application No. PCT/AT00/00091, filed on Apr. 14, 2000.

(30) Foreign Application Priority Data

Apr. 16, 1999 (FR) ..... 99/04844

(51) Int. Cl.[7] ..... B21D 31/04
(52) U.S. Cl. ..... 29/6.1; 29/6.2
(58) Field of Search ..... 29/6.1, 6.2, 2, 29/623.1, 730, 731

(56) References Cited

U.S. PATENT DOCUMENTS

| | | | | | |
|---|---|---|---|---|---|
| 1,562,157 | A | * | 11/1925 | Gersman | 29/6.2 |
| 2,104,249 | A | * | 1/1938 | Vass | 29/6.2 |
| 3,206,536 | A | * | 9/1965 | Goodloe | 174/35 GC |
| 3,591,351 | A | * | 7/1971 | Ullman | 428/597 |
| 3,812,558 | A | * | 5/1974 | Watanabe | 29/6.1 |
| 3,890,160 | A | * | 6/1975 | Daniels, Jr. | 29/623.1 |
| 3,945,097 | A | * | 3/1976 | Daniels et al. | 29/2 |
| 4,305,187 | A | * | 12/1981 | Iwamura et al. | 29/2 |
| 4,621,397 | A | * | 11/1986 | Schrenk | 29/6.1 |
| 4,881,307 | A | * | 11/1989 | Gaissmaier | 29/6.1 |
| 5,060,352 | A | * | 10/1991 | Barker | 29/6.1 |
| 5,088,170 | A | * | 2/1992 | Spath | 29/6.1 |
| 5,095,597 | A | * | 3/1992 | Alhamad et al. | 29/6.1 |
| 5,142,755 | A | * | 9/1992 | Alhamad et al. | 29/6.1 |
| 5,207,756 | A | * | 5/1993 | Alhamad et al. | 29/6.1 |
| 5,781,976 | A | * | 7/1998 | Stuhlbacher et al. | 29/6.1 |
| 6,062,316 | A | * | 5/2000 | Alhamad | 169/45 |
| 6,202,271 | B1 | * | 3/2001 | Goda et al. | 29/6.2 |
| 6,212,744 | B1 | * | 4/2001 | Inanobe et al. | 29/6.1 |
| 6,425,181 | B2 | * | 7/2002 | Ghizzoni et al. | 29/890.06 |
| 6,526,637 | B1 | * | 3/2003 | Geissler | 29/6.1 |

FOREIGN PATENT DOCUMENTS

| | | | | |
|---|---|---|---|---|
| EP | 0 377 397 A | | 7/1990 | |
| GB | 2 071 530 A | * | 9/1981 | B23P/17/00 |
| WO | WO 98/09747 | | 3/1998 | |

* cited by examiner

*Primary Examiner*—Gregory Vidovich
*Assistant Examiner*—Essama Omgba
(74) *Attorney, Agent, or Firm*—Henry M. Feiereisen

(57) ABSTRACT

A filling material includes a web of sheet made of metal, in particular aluminum, or of dimensionally stable flexible material, especially plastic, with the sheet being perforated with evenly spaced slits extending parallel in longitudinal direction of the band and stretched transversely to the longitudinal extension, and with the sheet profiled transversely to the longitudinal extension.

10 Claims, 5 Drawing Sheets

FILLING MATERIAL, AND METHOD OF AND ARRANGEMENT FOR MAKING SUCH A FILLING MATERIAL

CROSS-REFERENCES TO RELATED APPLICATIONS

This application is a continuation of prior filed copending PCT International application no. PCT/AT00/00091, filed Apr. 14, 2000.

This application claims the priority of French Patent Application Serial No. 99/04844, filed Apr. 16, 1999, the subject matter of which are incorporated herein by reference.

BACKGROUND OF THE INVENTION

The present invention relates, in general, to filling materials, and to a method of and arrangement for making such a filling material.

Filling materials of the type involved here, are generally made from a web-like sheet material of metal, in particular aluminum, or of dimensionally stable flexible material, especially plastic. The sheet material is typically perforated with evenly spaced slits in parallel relation to the longitudinal extension and stretched transversely across the sheet web. Filling material of this type is oftentimes used, i.a., for filling containers containing combustible fluid to prevent explosive combustion of liquids as a result of a rapid heat transfer.

It is known to provide the cuts in a flat sheet web in longitudinal direction of the sheet web, and then the sheet web is stretched in this flat form transversely to the longitudinal extension. As a result, only a slight deformation from the web plane is implemented. It has been shown that as a consequence of the slight deformation out of the web plane, the individual layers of the sheets bake together in the containers or interlock through movement, thereby creating free spaces within the container in which combustible liquid is present without the respective sheet inlays. As a consequence, explosive combustion may occur.

It would therefore be desirable and advantageous to provide an improved filling material to obviate prior art shortcomings, and to provide a method of and arrangement for making such a filling material.

SUMMARY OF THE INVENTION

The present invention provides for a filling material made from a web-like sheet which is perforated with evenly spaced slits, extending parallel in the direction of the longitudinal axis, and profiled transversely to the longitudinal axis.

The profiling of the sheet transversely to the longitudinal extension is maintained during stretching so that the deformation out of the sheet plane is effected in addition to the profiling during stretching, resulting, on the one hand, in a higher elevation out of the web area and, on the other hand, a more stable deformation transversely to the web area.

According to another feature of the present invention, the profile of the sheet may be formed by undulations extending preferably across the entire sheet width so as to realize a simple continuously producible profiling. An even greater strength of the sheet transversely to the sheet plane can be realized when providing the wavy profile with edged transitions.

According to another aspect of the present invention, a filling material of the above-stated type can be made by a method in which a web-like sheet of metal, in particular of aluminum, or of dimensionally stable flexible material, especially plastic, is provided with evenly spaced slits in parallel relation to one another and to the longitudinal extension of the sheet, subsequently formed with an undulated profile, and thereafter stretched transversely to the longitudinal direction, thereby realizing a filling material which has been profiled in a superior way.

According to still another aspect of the present invention, an arrangement for carrying out the above-stated method includes a conveyor for transporting the sheet, a cutting tool for formation of intermittent slits in the sheet, a device for stretching the slitted sheet, with the device having a clamping unit for the longitudinal edges of the sheet and an ascending contact body, and a profiling unit, positioned upstream of the stretching device, for providing the slitted sheet with an undulated profile. Such an arrangement is simple in structure and permits a continuous fabrication of such a filling material.

According to another feature of the present invention, the profiling unit is formed by a pair of interlocking profiling drums so that a profile is realized by rolling tools which permit a high processing speed. A reliable transport and also clamping of the edge of the sheet web in the clamping unit can be realized when the profile provided in the sheets by the profiling drums corresponds to the profile of the clamping unit for the longitudinal edges of the sheet. Hereby, the profile of the clamping unit may be provided at the margins of two clamping wheels which are embraced at their profiled peripheral surfaces over a portion of the circumference by respective clamping belts. The profiling unit thus also realizes a continuous uniform advance of the sheet. The same purpose and a high advance speed can be realized by arranging the center of both clamping wheels eccentric to the center of a rotating stretching body, whereby a maximum eccentricity is established in the area of the portion of the clamping wheels embraced by the clamping belt. In this manner, it is possible to omit lubrication of the material during its passage through the arrangement. This is especially relevant when the filling material is subject to further processing, e.g., by lacquer or other coats.

According to a variation, the clamping belt may be configured as a flat belt which bears upon the outer peripheral surfaces of radially outwardly directed projections of the clamping wheels profiled at their circumferential surfaces. This has the advantage that clamping of the sheet margins does not occur over the entire length but only along portions, so as to implement a stretching action in the area of the clamped regions entirely up to the margins, whereas those areas which are located between the clamped regions are subject to less stretching so that the sheet margin moves inwardly in an undulated manner. This is advantageous when introducing into the container bundles of stretched sheet material, bearing upon one another at their flat side regions, so that the bundles interlock and are hindered from shifting relative to one another as a consequence of the uneven surface.

According to another feature of the present invention, the clamping belt may be configured as profiled belt with a profile directed outwards and complementing the profile of the clamping wheels so that the sheet margins are held over their entire length in such a manner that as a consequence of the pre-profiling of the sheet web the profile engages like a gear in the outer profile of the clamping wheels and is held in this position by the toothed belt. In the area of maximum eccentricity, the spacing between the circumference of the stretching body and the clamping unit can hereby be greater than half the width of the stretched sheet material so that the sheet margins are pulled out between the clamping parts in the clamped region, thereby ensuring that the stretching of the sheet is effected up to the edge zone so that marginal regions do not remain unstretched as experienced in conventional constructions.

The rotating stretching body may be supported for free rotation, and thus solely moved by the sheet drawn above it so that relative speeds between the sheet and the stretching body are avoided and the sheet rolls off in the desired stretching over the rotating stretching body. In addition, the rotating stretching body may itself be supported eccentrically to thereby establish an even greater irregularity.

The filling material according to the present invention may be used not only for filling of containers for explosion-prone fluids but has shown to be very effective in solar collectors because a reflection of incident light quantity cannot occur when the filling sheets are blackened, but rather, incident solar energy is retained in the material as a consequence of inner reflections, resulting in a particularly good heating of water or air flowing through the solar collector.

BRIEF DESCRIPTION OF THE DRAWING

Other features and advantages of the present invention will be more readily apparent upon reading the following description of preferred exemplified embodiment of the invention with reference to the accompanying drawing, in which.

DETAILED DESCRIPTION OF PREFERRED EMBODIMENTS

Figure 1:
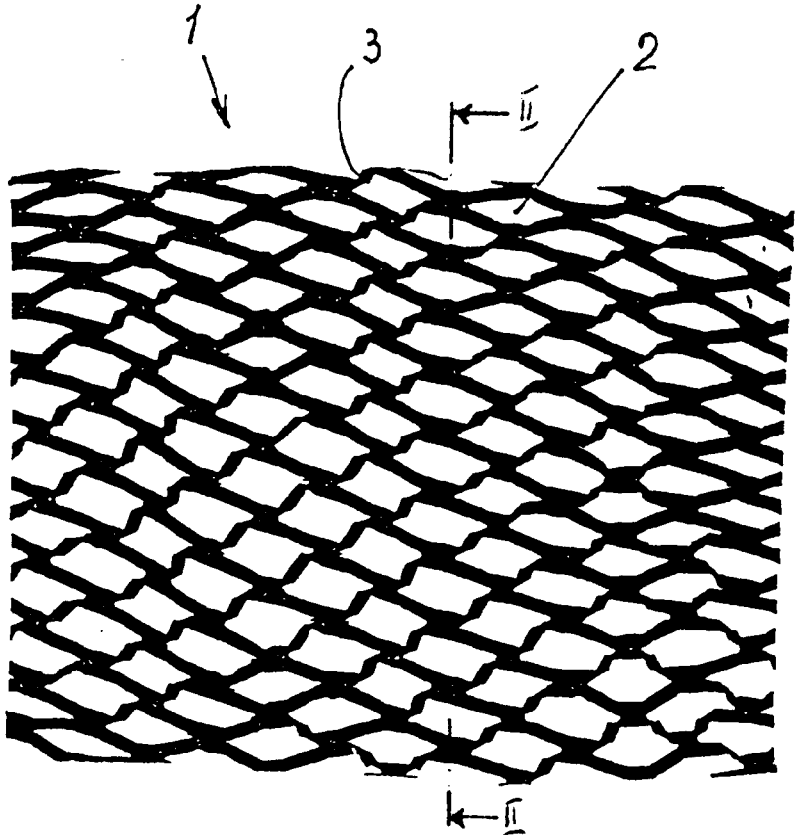
FIG. 1 shows a plan view of a filling material according to the present invention.

Throughout all the Figures, same or corresponding elements are generally indicated by same reference numerals.

Figure 2:
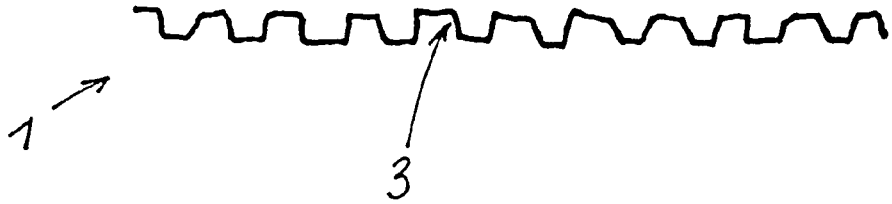
FIG. 2 is a sectional view of the filling material, taken along the line II—II of FIG. 1.

Turning now to the drawing, and in particular to FIG. 1, there is shown a plan view of a segment of a finished web-like sheet for use as filling material according to the present invention, generally designated by reference numeral 1. The sheet 1 has openings 2 which are formed through provision of slits 1' (FIG. 6) in the sheet web and subsequent stretching, whereby the sheet 1 is profiled, as shown in FIG. 2, transversely to the longitudinal extension through undulations 3 which have edged transitions.

Figure 3:
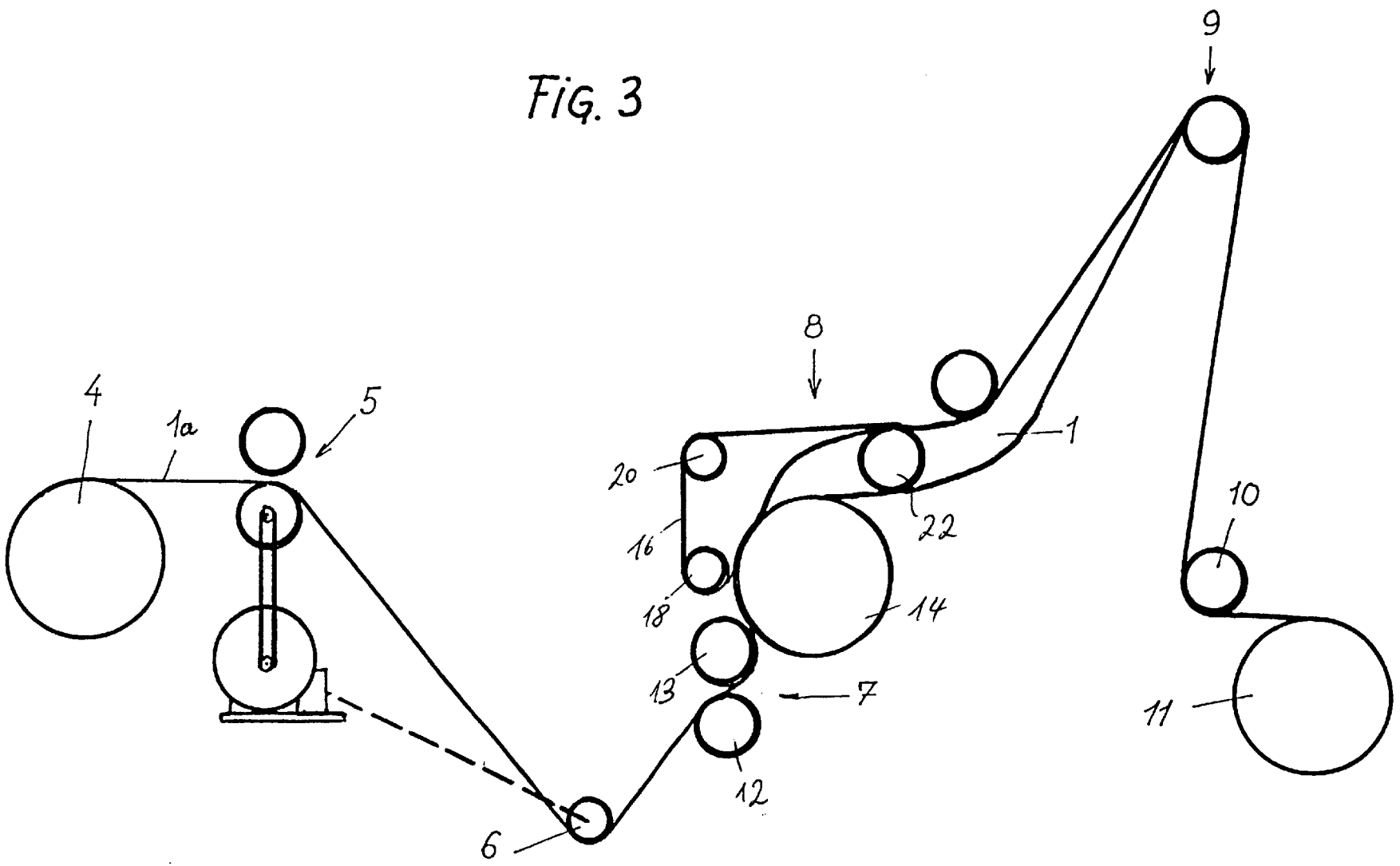
FIG. 3 is a simplified, schematic illustration of an arrangement for making a filing material in accordance with the present invention.

Referring to FIG. 3, there is shown a simplified, schematic illustration of an arrangement for making the finished sheet 1 in accordance with the present invention. A web 1*a* of sheet material, made of metal, e.g. aluminum, or dimensionally stable flexible material, e.g. plastic, is drawn from a storage roll 4 and transferred to a subsequent cutting station 5 to provide the sheet material with cuts 1' which extend parallel to one another in longitudinal direction of the sheet web. The cuts 1' are arranged in rows, as known in conventional constructions of this type, with each row that follows the leading row being offset laterally by half the space between the slits, so that the openings 2 are formed when the sheet web is stretched transversely just like an expanded metal. The sheet web emerging from the cutting station 5 is guided over a tension roller 6 and fed to a profiling unit 7 from which it is transferred to a stretching station 8 in which the sheet 1*a* is transformed to the final configuration of the sheet 1, as shown in FIG. 1. The sheet 1 is then guided via a flattening roller 9 and a tension roller 10 to a product take-up station 11.

Figure 4:
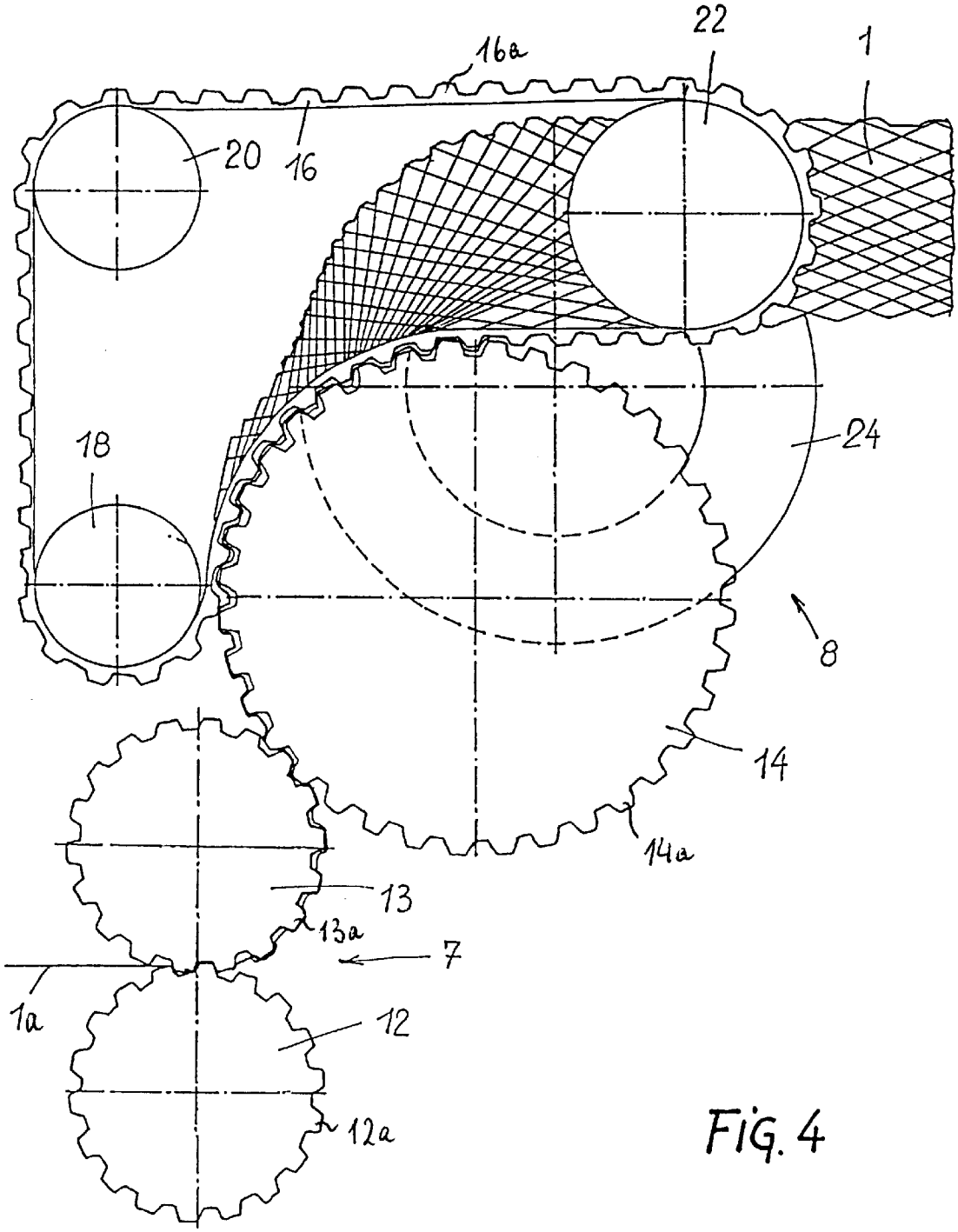
FIG. 4 is a schematic illustration of a profiling and stretching station forming part of the arrangement of FIG. 3.

FIG. 4 shows in more detail the profiling unit 7 and the stretching station 8. The profiling unit 7 includes two profiling drums 12, 13 disposed in superimposed relationship and having an outer surface area formed with uniform longitudinal ribs 12*a*, 13*a*, with the longitudinal ribs 12*a* of the drum 12 engaging in the intermediate spaces between the longitudinal ribs 13*a* of the drum 13, so as to realize a meshing engagement of the drums 12, 13 with one another. The sheet web 1*a* entering the profiling unit 7 and already provided with the cuts in longitudinal direction of the sheet, is conducted between the gap between both profiling drums 12, 13 and transferred to the stretching station 8. This stretching station 8 has two clamping wheels 14, 15 (only clamping wheel 14 is visible in the illustration here in spaced-apart disposition, with the mean spacing of both clamping wheels 14, 15 corresponding approximately to the width of the sheet emerging form the profiling unit 7. The clamping wheels 14, 15 have on their outside a profile in the form of teeth 14*a* which complement the ribs 12*a*, 13*a* of the profiling drums 12, 13, so that the sheet emerging from the profiling unit 7 and provided with undulations, engages directly in the teeth of the clamping wheels 14, 15. Trained over a portion of the perimeter of the clamping wheels 14, 15 are belts 16, 17 (only belt 16 is visible in the illustration here). In the non-limiting example of FIG. 4, the belts 16, 17 are configured as toothed belts, having teeth 16*a* only the teeth 16*a* of the belt 16 are visible in the illustration here) directed outwards and engaging the teeth 14*a* of the clamping wheels 14, 15 such that the belts 16, 17 restrain the sheet web 1 upon the clamping wheels 14, 15.

Figure 5:
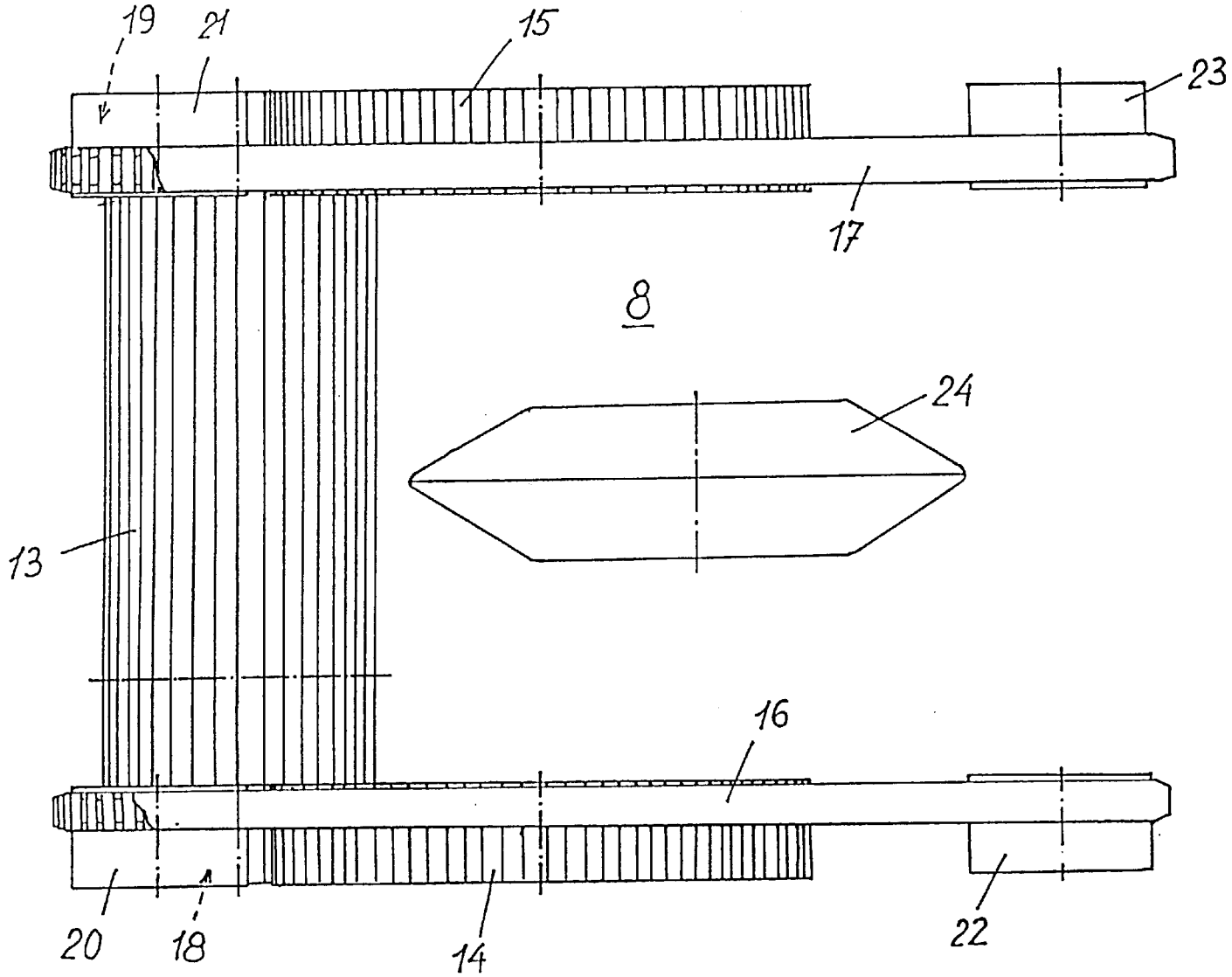
FIG. 5 is a plan view of the profiling and stretching station of FIG. 4, without illustration of a sheet web.

As shown in conjunction with FIG. 5, the clamping belts 16, 17 are trained over deflection rollers 18, 19, 20, 21 and 22, 23, with the contact area established by about ¼ of the circumference of the clamping wheels 14, 15. The rollers 18, 20 and 19, 21 are arranged directly above one another. This is indicated in FIG. 5 by providing the reference characters 18, 19 with dashed reference lines pointing in the direction of the rollers 20 and 21. Also indicated by FIGS. 4 and 5 is the disposition of the rollers 18, 19 directly beneath the rollers 20, 21, respectively. Disposed between the clamping wheels 14, 15 is a stretching body in the form of a freely rotatably supported stretching wheel 24, whereby the outer surface area of the stretching wheel 24 is formed by the outer surface areas of two truncated cones with adjoining bases. This formation allows a particularly good stretching in both directions, also in mid-area, without causing an excessive buckling.

As can be seen from FIG. 4, the stretching wheel 24 is supported eccentrically to the clamping wheels 14, 15, with the greatest eccentricity being arranged behind the release area of the sheet web 1 from the clamped engagement between the clamping belts 16, 17 and the clamping wheels 14, 15. The greatest distance between the outer circumference of the stretching wheel 24 and the perimeter of the clamping wheels 14, 15 is hereby greater than the width of the stretched material so that—as already set forth above—the sheet web is pulled out in transverse orientation from the clamped engagement between the clamping wheels 14, 15 and the clamping belts 16, 17 so that the stretching action is realized up to the outermost edge area of the sheet web 1.

Figure 6:
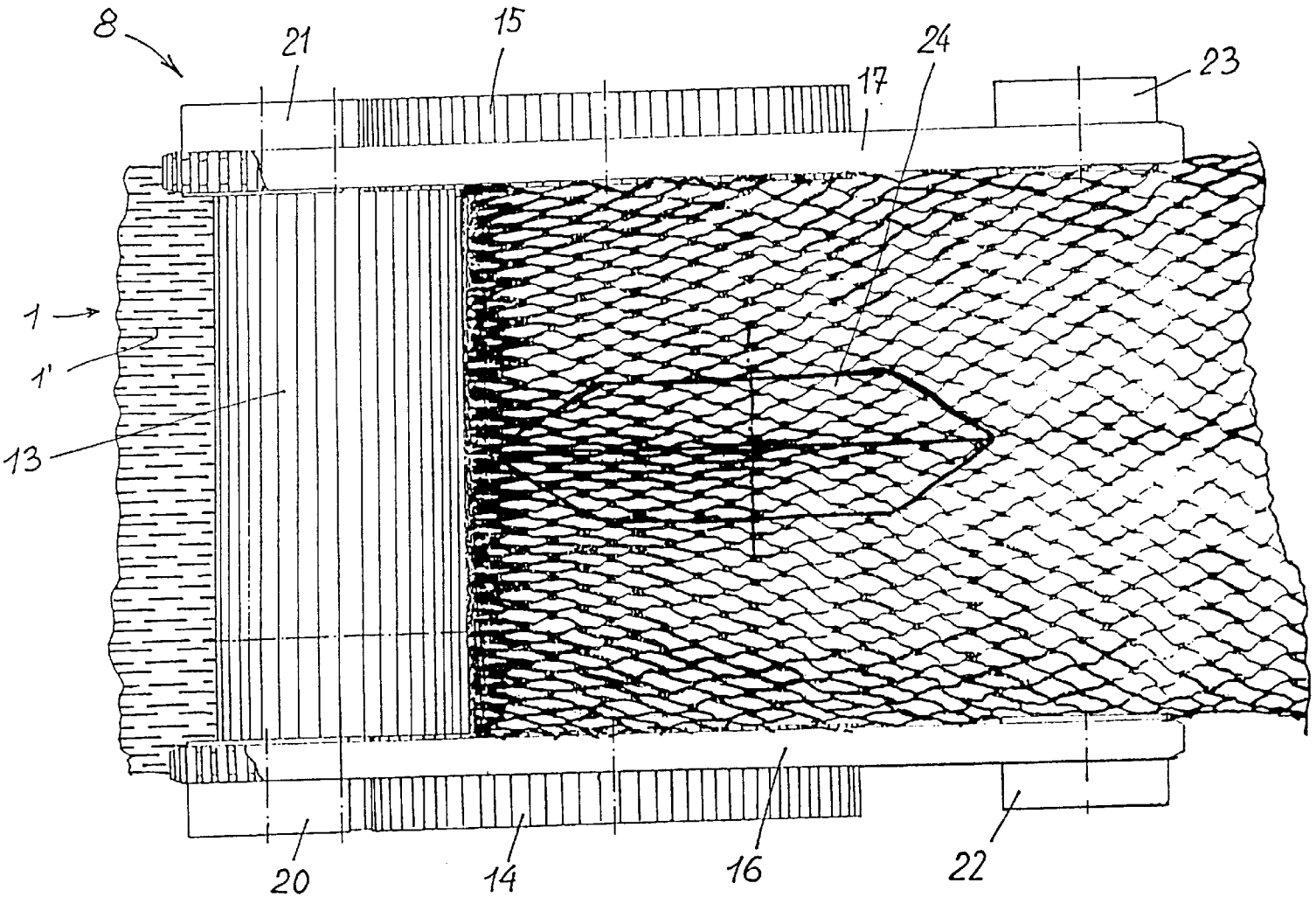
FIG. 6 is a plan view analogous to FIG. 5, with illustration of a sheet web located.

FIG. 6 shows the manner in which the sheet web 1 is altered by the stretching action. The sheet web 1 with its slits 1', introduced before manipulation by the profiling unit 7 between the profiling drums 12, 13, is already pre-stretched during ascension via the stretching wheel 24, whereby stretching and release are clearly recognizable by the increasingly widening openings 2.

In the drawing, the clamping belts 16, 17 are shown in the form of toothed belts. Of course, other configurations are suitable as well, e.g. the configuration of the clamping belts as flat belts which thus bear only upon the outer surfaces of the outwardly projecting profiles of the clamping wheels 14, 15 so that a clamped engagement occurs locally only there and the sheet web 1 is not retained in the area of the indentations between the projections of the clamping wheels 14, 15. This results in a more pronounced stretching in the area of contact upon the outer surfaces of the projections than between the projections, so that the outer margin of the sheet web is slightly undulated.

Although also not shown in the drawing in detail, the rotating stretching body 24 may itself be support eccentrically, thereby further increasing the irregularities of the stretching and realizing a undulated edge which has a greater length of undulation than the undulation as a result of the use of the flat belt.

While the invention has been illustrated and described as embodied in a filling material, and method of and arrangement for making such a filling material, it is not intended to be limited to the details shown since various modifications and structural changes may be made without departing in any way from the spirit of the present invention.

What is claimed as new and desired to be protected by Letters Patent is set forth in the appended claims:

What is claimed is:

1. An arrangement for making a filling material, comprising:

a conveyor for transporting a web-like sheet of a material selected from the group consisting of metal and dimensionally stable flexible material;

a cutting tool for formation of slits in the sheet;

stretching means for stretching the slitted sheet, said stretching means including a clamping unit for grasping longitudinal edges of the sheet; and a profiling unit, positioned upstream of the stretching means, for providing the slitted sheet with an undulated profile, wherein the profiling units includes a pair of interlocking profiling drums which provide the sheet with a profile which corresponds to a profile of the clamping unit for the longitudinal edges of the sheet.

2. The arrangement of claim 1, wherein the metal is aluminum.

3. The arrangement of claim 1, wherein the flexible material is plastic.

4. The arrangement of claim 1, wherein the clamping unit has two spaced-apart clamping wheels, each provided with a profiled peripheral surface, thereby forming the profile of the clamping unit, and two clamping belts which are trained over part of the profiled peripheral surface of the clamping wheels, whereby the clamping wheels and the clamping belts are placed into one-to-one correspondence.

5. The arrangement of claim 4, wherein the clamping unit includes a rotating stretching body which defines a center, said clamping wheels defining centers arranged eccentric to the center of the stretching body, with a maximum eccentricity established in an area of the part of the peripheral surface over which the clamping belts are trained about the clamping wheels.

6. The arrangement of claim 5, wherein the stretching body is positioned at a distance to the clamping wheels, wherein in the area of maximum eccentricity, the distance between a circumference of the stretching body to a circumference of the clamping unit is greater than half a width of the stretched sheet.

7. The arrangement of claim 5, wherein the rotating stretching body is supported for free rotation.

8. The arrangement of claim 5, wherein the rotating stretching body is supported eccentrically.

9. The arrangement of claim 4, wherein the profiled peripheral surface of each of the clamping wheels has radially outwardly directed projections, each of said clamping belts configured as a flat belt which bears upon the projections of the clamping wheels.

10. The arrangement of claim 4, wherein each of the clamping belts is configured as a profiled belt with a profile directed outwards and complementing the profile of the clamping wheels.

* * * * *